US012330009B2

(12) United States Patent
Westfall

(10) Patent No.: US 12,330,009 B2
(45) Date of Patent: Jun. 17, 2025

(54) EXTENDABLE FITNESS BAR WITH INTERNAL RESISTANCE

(71) Applicant: Jack Westfall, Limestone, ME (US)

(72) Inventor: Jack Westfall, Limestone, ME (US)

( * ) Notice: Subject to any disclaimer, the term of this patent is extended or adjusted under 35 U.S.C. 154(b) by 0 days.

(21) Appl. No.: 18/762,290

(22) Filed: Jul. 2, 2024

(65) Prior Publication Data

US 2024/0350851 A1 Oct. 24, 2024

Related U.S. Application Data

(62) Division of application No. 17/552,927, filed on Dec. 16, 2021, now Pat. No. 12,053,661.

(51) Int. Cl.

| | |
|---|---|
| ***A63B 21/04*** | (2006.01) |
| ***A63B 21/00*** | (2006.01) |
| ***A63B 21/055*** | (2006.01) |

(52) U.S. Cl.

CPC ..... *A63B 21/0428* (2013.01); *A63B 21/0557* (2013.01); *A63B 21/4035* (2015.10)

(58) Field of Classification Search

CPC ..... A63B 21/00043; A63B 21/023; A63B 21/0428; A63B 21/045; A63B 21/0455; A63B 21/055; A63B 21/0552; A63B 21/0555; A63B 21/0557; A63B 21/4035; A63B 21/4045; A63B 21/4049

See application file for complete search history.

(56) References Cited

U.S. PATENT DOCUMENTS

| | | | |
|---|---|---|---|
| 3,971,255 | A | 7/1976 | Varney et al. |
| 4,193,593 | A | 3/1980 | Wilson |
| 4,376,533 | A | 3/1983 | Kolbel |
| 4,489,937 | A | 12/1984 | Kong |
| 4,623,146 | A | 11/1986 | Jackson |
| 4,695,049 | A | 9/1987 | Ciemiega |
| 4,913,417 | A | 4/1990 | Francu |
| 5,569,137 | A | 10/1996 | Uen |
| 5,620,397 | A | 4/1997 | Chieh |
| 5,830,110 | A | 11/1998 | Fielding |
| 8,777,821 | B2 | 7/2014 | Lando et al. |
| 9,132,315 | B1 | 9/2015 | Chen |
| 10,806,960 | B2 | 10/2020 | Sanseverino |

(Continued)

FOREIGN PATENT DOCUMENTS

| | | | |
|---|---|---|---|
| CN | 101711912 | A | 5/2010 |
| CN | 113426075 | A | 9/2021 |

(Continued)

*Primary Examiner* — Gary D Urbiel Goldner

(74) *Attorney, Agent, or Firm* — Stephen J. Kenny; Sameer K. Pai; Foley Hoag LLP

(57) ABSTRACT

An extendable fitness bar including an internal elastic member. The extendable fitness bar includes two, hollow external bars with ends facing one another. On an interior of the two external bars is an internal bar. The internal elastic member extends through the two external bars and the internal bar. The internal elastic member is attached to a far end of each of the external bars. A user can grasp each external bar and separate them, exposing the internal bar and creating a longer continuous bar. This separation also causes the internal elastic member to stretch creating tension. The user may also twist the two external bars in opposing directions (clockwise and counterclockwise) for additional stretches.

8 Claims, 8 Drawing Sheets

(56) References Cited

U.S. PATENT DOCUMENTS

| | | | | |
|---|---|---|---|---|
| 10,974,087 | B1 | 4/2021 | Moon et al. | |
| 12,053,661 | B2 * | 8/2024 | Westfall | A63B 21/023 |
| 2002/0082102 | A1 | 6/2002 | Reilly | |
| 2004/0132590 | A1 | 7/2004 | Papas | |
| 2004/0152571 | A1 | 8/2004 | Udwin | |
| 2006/0094573 | A1 | 5/2006 | Weck | |
| 2010/0216613 | A1 | 8/2010 | Pacini | |
| 2010/0227747 | A1 | 9/2010 | Cook | |
| 2011/0269607 | A1 | 11/2011 | Choi | |
| 2014/0094323 | A1 | 4/2014 | Roberts | |
| 2014/0221173 | A1 | 8/2014 | Crabtree et al. | |
| 2018/0028856 | A1 | 2/2018 | Sanseverino | |
| 2019/0099634 | A1 | 4/2019 | Sanseverino | |
| 2020/0009416 | A1 | 1/2020 | Del Conte | |
| 2021/0121728 | A1 | 4/2021 | Livensparger | |
| 2023/0191181 | A1 | 6/2023 | Westfall | |

FOREIGN PATENT DOCUMENTS

| | | | |
|---|---|---|---|
| DE | 2020/06007944 | U1 | 7/2006 |
| DE | 102009039742 | A1 | 6/2012 |
| DE | 2020/18105995 | U1 | 11/2018 |
| EP | 0688584 | A1 | 12/1995 |
| KR | 2010/0089182 | A | 8/2010 |
| KR | 2013/0001173 | U | 2/2013 |
| KR | 101292937 | B1 | 8/2013 |
| KR | 2019/0053580 | A | 5/2019 |
| KR | 102263354 | B1 | 6/2021 |
| KR | 2021/0112636 | A | 9/2021 |
| KR | 102597629 | B1 | 11/2023 |
| WO | WO-02/096522 | A1 | 12/2002 |
| WO | WO-2021/231595 | A1 | 11/2021 |

* cited by examiner

EXTENDABLE FITNESS BAR WITH INTERNAL RESISTANCE

CROSS REFERENCE TO RELATED APPLICATIONS

This application is a divisional of U.S. patent application Ser. No. 17/552,927, filed on Dec. 16, 2021, entitled EXTENDABLE FITNESS BAR WITH INTERNAL RESISTANCE, which is hereby incorporated by reference in its entirety.

BACKGROUND OF THE INVENTION

Field of the Disclosed Subject Matter

The disclosed subject matter relates to a low cost, convenient, and multipurpose workout equipment and its use. Particularly, the present disclosed subject matter is directed to an extendable fitness bar with an internal resistance cord.

Description of Related Art

Although shoulder, elbow, rotator cuff, upper back, bicep, and forearm injuries can be common, many of the traditional equipment that exist to help with physical therapy have their issues. Some exercises help with eccentric contraction or isometric contractions, while others help with strengthening forearm muscles. Using a resistance band alone can be awkward and difficult to hold and use. Further using additional equipment can be costly and take up significant space.

There thus remains a need for a convenient and inexpensive, workout equipment for shoulder and elbow injuries, in particular an extendable fitness bar with an internal resistance cord. The present invention addresses these and other disadvantages of the prior art.

BRIEF SUMMARY OF THE DISCLOSURE

The purpose and advantages of the disclosed subject matter will be set forth in the description below. Additional advantages of the disclosed subject matter will be realized by the specific embodiments disclosed in the written description, claims and included drawings.

To achieve these advantages as well as others relating to the purpose of the disclosed subject matter as embodied and described, the disclosed subject matter includes an extendable fitness bar with an internal resistance component.

The extendable fitness bar is made up of two external bars that lock together by two connecting pieces located at the end of each external bar.

The extendable fitness bar includes an internal bar located on the interior of the two external bars. When the user pulls each external bar in the opposite direction, this increases the distance between the two external bars, and exposes the internal bar creating a longer, continuous bar. The extendable fitness bar also having an elastic member that may be in the form of a resistance cord. The elastic member having a first and second end, located in the interior of the internal bar, attached to each end of the external bars so that when the two external bars are separated it creates tension.

The extendable fitness bar discussed above operates by having the user grasp each external bar directing them in opposing directions creating distance between the first external bar and the second external bar and exposing the internal bar. This causes the elastic member to stretch, creating tension. This is useful for muscle stretching and strength exercises for example. Another method of using the extendable fitness bar includes grasping each external bar twisting them in opposite directions (clockwise or counterclockwise). This is also useful for muscle stretching and strength exercises for example.

It is to be understood that the general description and detailed description are exemplary and not intended to be limiting but instead for further explanation of the disclosed subject matter.

The included drawings, which constitute part of this specification, are provided to illustrate and help further the understanding of the product of the disclosed subject matter.

BRIEF DESCRIPTION OF THE DRAWINGS

A detailed description of various aspects, features, and embodiments of the subject matter described herein is provided with reference to the accompanying drawings, briefly described below. The drawings illustrate various aspects and features of the present subject matter and may illustrate one or more embodiment(s) or example(s) of the present subject matter in whole or part. The drawings are intended to be illustrative, not limiting in nature, are not necessarily drawn to scale, and may exaggerate components to provide clarity.

Like or identical reference numbers are used to identify common or similar elements.

DETAILED DESCRIPTION

Reference will now be made in detail to exemplary embodiments of the disclosed subject matter, this embodiment is illustrated in the provided drawings.

Figure 1:
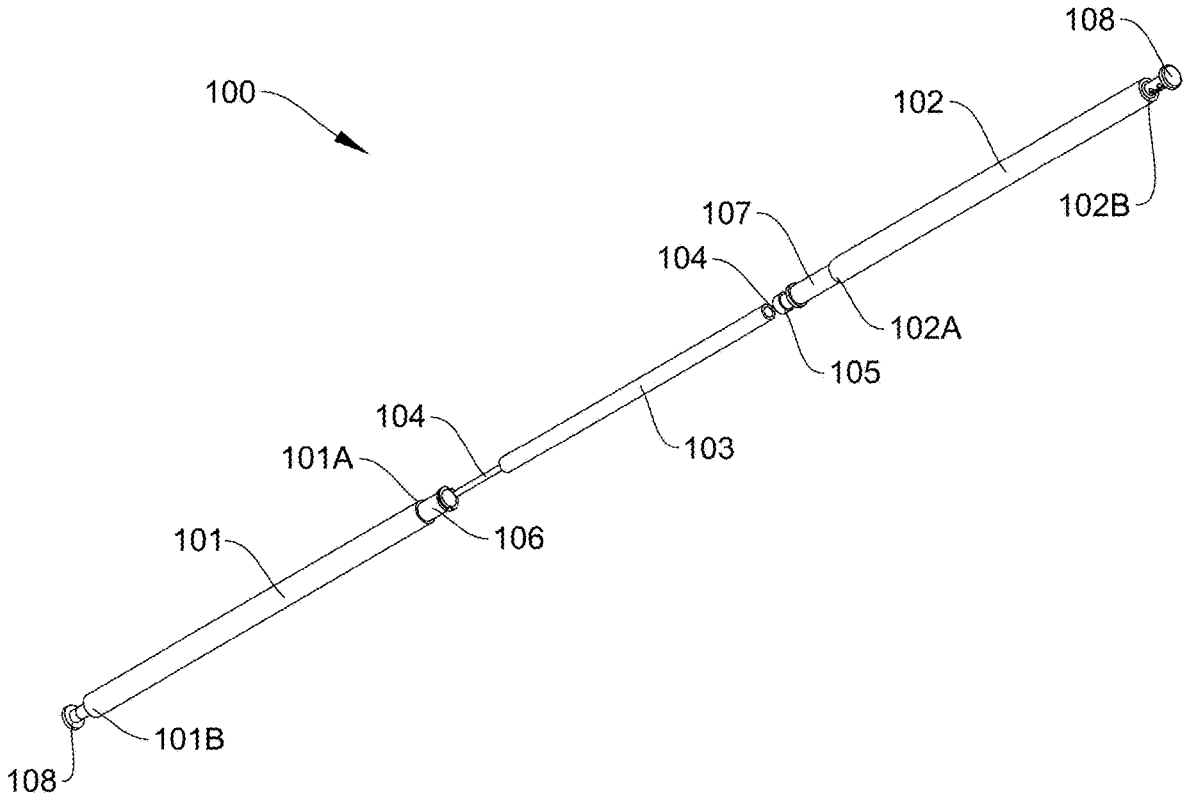
FIG. 1 is a schematic representation of the extendable fitness bar including the elastic component.
Figure 2:
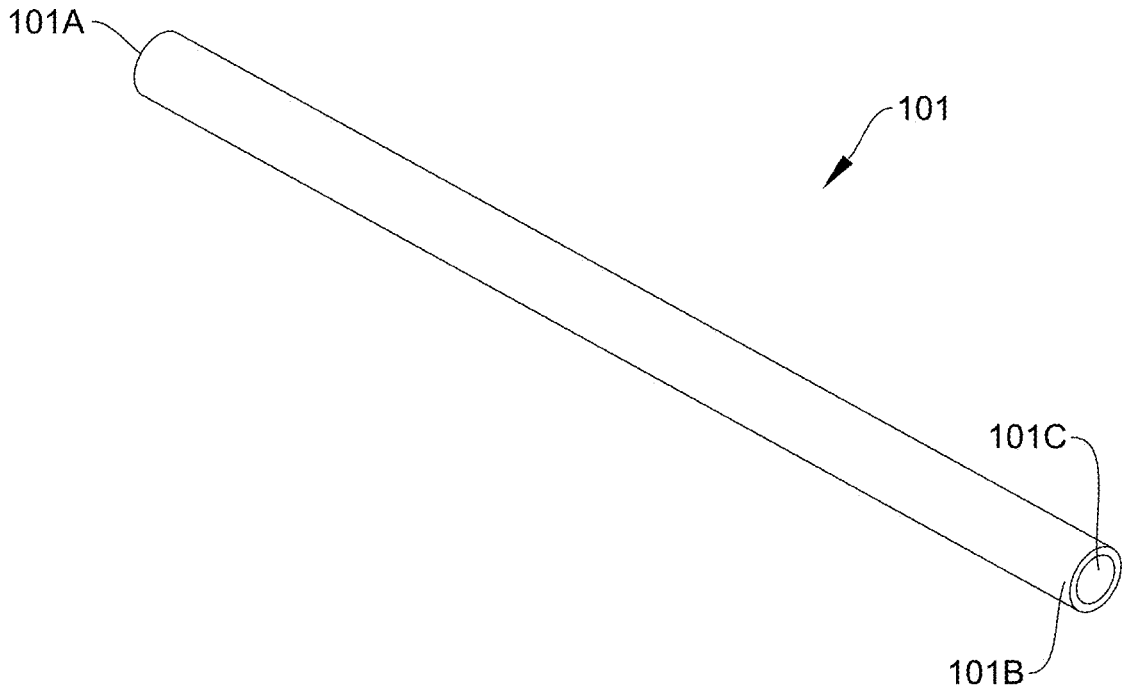
FIG. 2 is a schematic representation of the first external bar.
Figure 3:
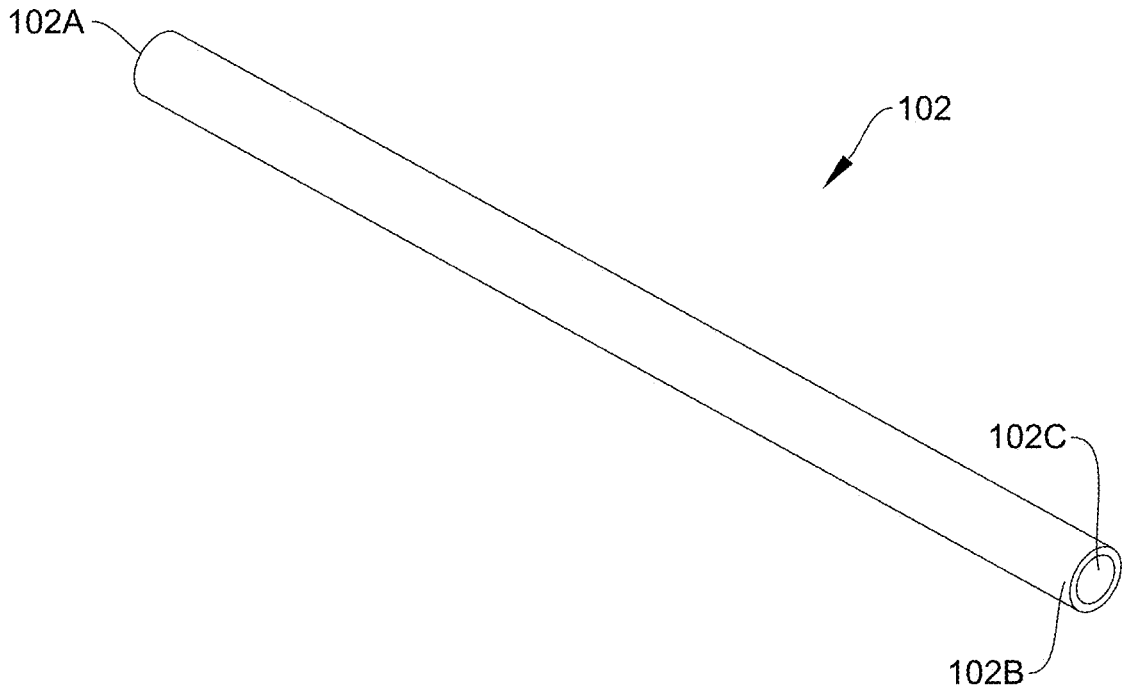
FIG. 3 is a schematic representation of the second external bar.
Figure 4:
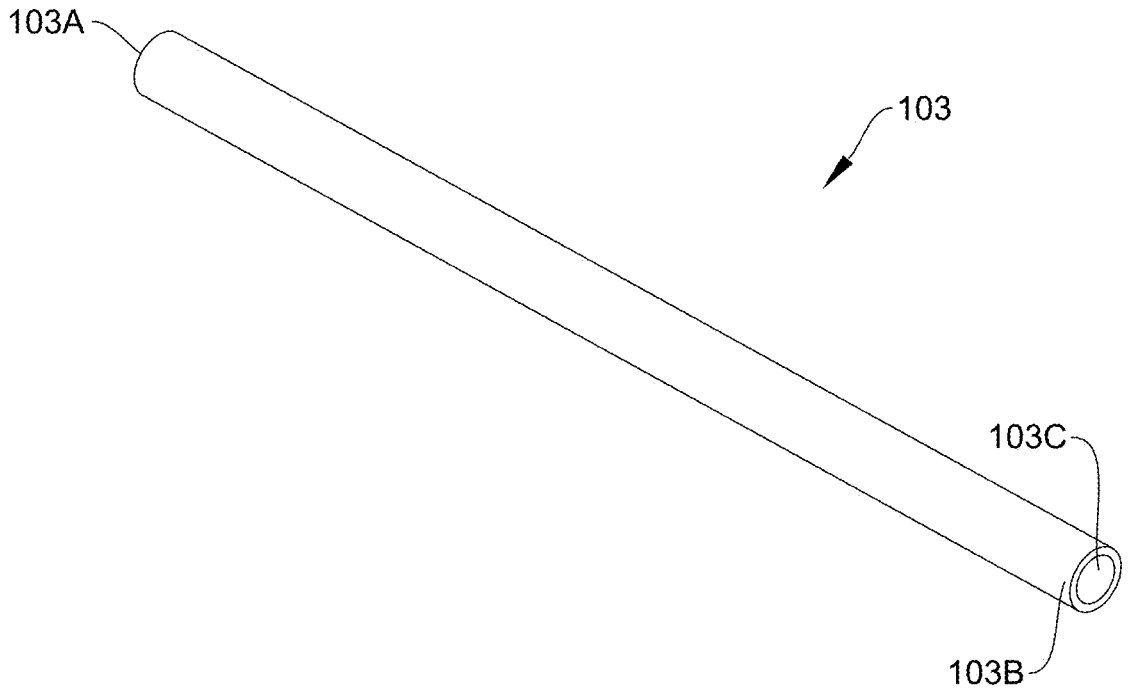
FIG. 4 is a schematic representation of the internal bar.
Figure 5:
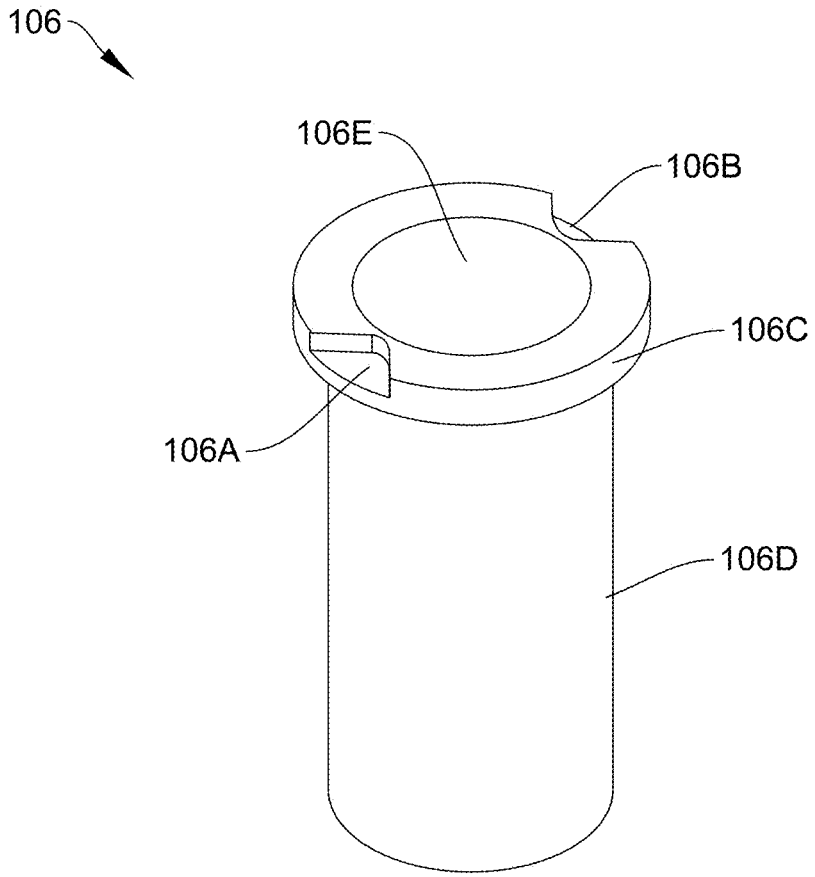
FIG. 5 is a schematic representation of the interlocking feature with the protrusions.
Figure 6:
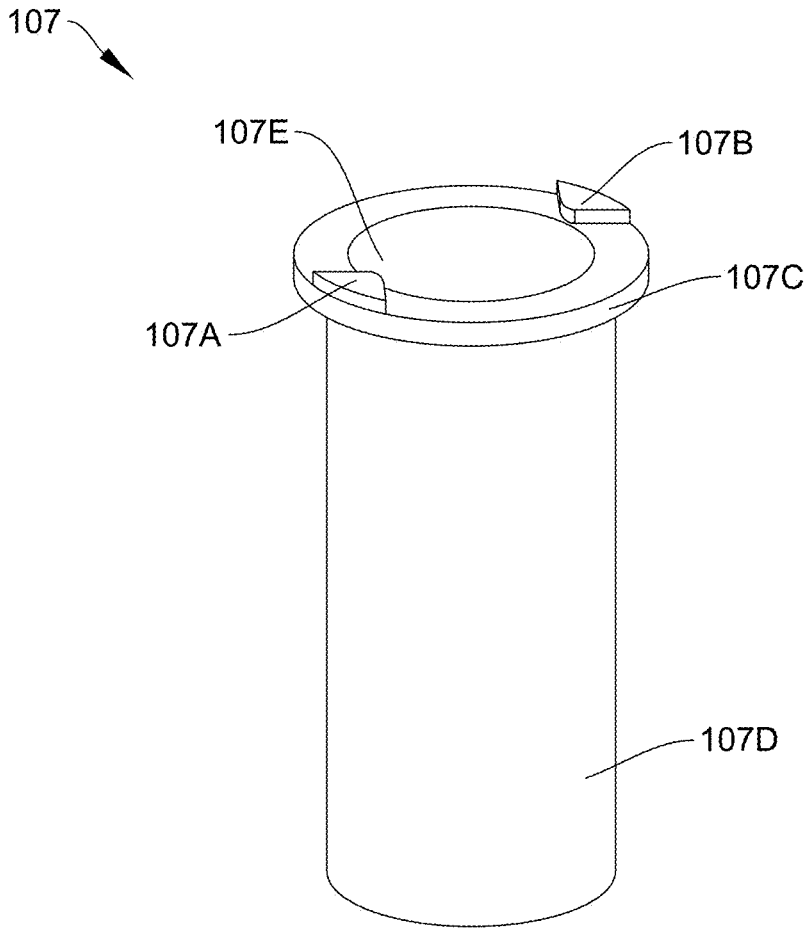
FIG. 6 is a schematic representation of the interlocking feature with the indents.

FIG. 1 discloses an exploded view showing the components of the extendable fitness bar and their particular orientation in accordance with one or more embodiments. The extendable fitness bar 100 includes a first external bar 101, a second external bar 102, an internal bar 103, an elastic member 104, a coupling member with one or more protrusions 106, a coupling member with one or more indents 107, a stabilizing fitting 105, and optional hollow attaching bars 108.

As shown in FIG. 1, the first external bar and the second external bar are oriented so that they have ends (proximal ends) directly facing one another 101A, 102A. Each external bar also have second ends (distal ends) that are furthest away from one another 101B, 102B. The first external bar and the second external bar are also hollow 101C, 102C. FIG. 1 also shows an internal bar 103, located in the interior of the first and second external bars. The internal bar is also hollow 103C. As shown in FIG. 1, there is an elastic member 103. The elastic member 104 has a first end that is attachable to the distal end 101B of the first external bar 101 and a second end that is attachable to distal end 102B of the second external bar 102, so that the elastic member 104 creates tension when the first external bar 101 and the second external bar 102 are moved away from one another, revealing the internal bar 103.

Figure 8:
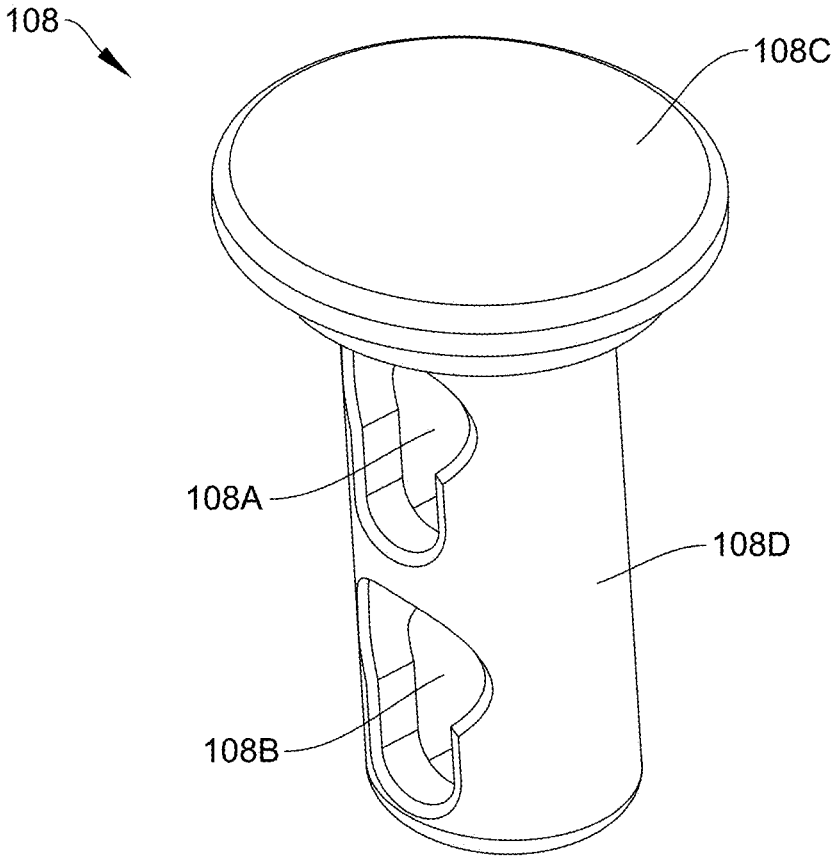
FIG. 8 is a schematic representation of the end caps.

Further FIG. 1 shows that the first end of the elastic member may be attachable to the distal end of the first external bar through a first hollow attaching bar 108 located at the distal end of the first external bar. And the second end of the elastic member may be attachable to the distal end of the second external bar through a second attaching bar 108 located at the proximal end of the second external bar, the first hollow attaching bar having one or more indent 108A, 108B any of which one end of the elastic member is attached to, the second hollow attaching bar having one or more indent 108A, 108B, any of which the second end of the elastic member is attached to. Each hollow attaching bar having a section that is internal to one of the external bars 108D, and a section that extends outside the external bar, and covers the entire end of the bar 108C as disclosed in FIG. 8.

The extendable fitness bar, may have a first interlocking bar 106 located at the proximal end 101A of the first external bar 101, and a second interlocking component 107 located at the proximal end 102A of the second external bar 102. One of the interlocking bars 106 having one or more indents 106A, 107B and the other interlocking bar 107 having one or more protrusions 107A, 107B that fit into the one or more indents 106A, 107B when the proximal end of the first external bar and the proximal end of the second external bar are pressed together. The first interlocking bar is hollow 106E, having a section that is internal to one of the external bars 106D, and a section that extends outside the external bar at proximal end of the external bar 106C, this section has about the same diameter as the external bar. The second interlocking bar is hollow 107E, having a section that is internal to one of the external bars 107D, and a section that extends outside the external bar at proximal end of the external bar 107C, this section has substantially the same diameter as the external bar.

In a particular embodiment, the internal and external bars 101, 102, 103 may be made out of the same or different material. The bars are preferably made of polyvinyl chloride (PVA), however they may also be made of, for example, high-density polyvinyl chloride, wood, metal, or plastic.

The elastic member 104 is preferably one or more elastic band or cord. The elastic member may also be for example a spring or another material used to generate resistance when elongated.

Figure 7:
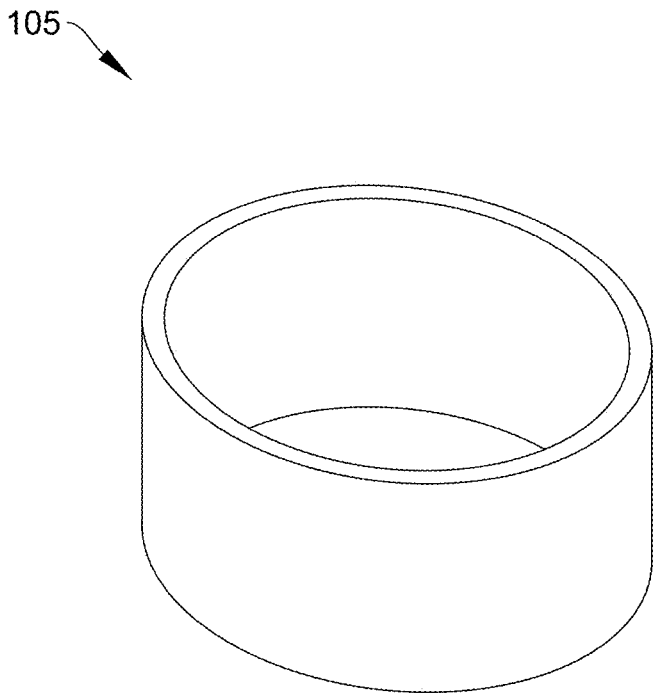
FIG. 7 is a schematic representation of the stabilizing fitting component.

The extendable fitness bar may also have an internal piece located on the interior of the first external bar and the second external bar, fixing the total distance the first external bar and the second external bar may separate from one another. In addition, the extendable fitness bar may contain a stabilizing fitting component, which may be in the form of a hollow ring 105, FIG. 1, FIG. 7 situated between the exterior bars and the interior bar, in order to account for the distance between the two bars along the axis of their radii.

Each external bar preferably has the same length and same diameter as one another, however in some embodiments they may differ. The length and diameter of the internal bar is not particularly limiting, however its diameter should be less than the diameters of the external bars so it may fit in the interior. The total distance the first and second external bars may separate is not particularly limiting but is preferably less than the total length of the internal bar.

The extendable fitness bar discussed above operates by having the user grasp the first external bar with one hand, and grasp the second external bar with another hand and directing the bars in opposing directions creating distance between the first external bar and the second external bar and exposing the internal bar. This causes the elastic member to stretch, creating tension. This is useful for muscle stretching and strength exercises for example.

The method of using the extendable fitness bar may separately or additionally include grasping the first external bar with one hand, and grasping the second external bar with another hand and twisting the first external bar clockwise and the second external bar counterclockwise. This is also useful for muscle stretching and strength exercises for example.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions.

Accordingly, the foregoing description and attached drawings are by way of example only, and are not intended to be limiting.

The invention claimed is:

1. A method of using an extendable fitness bar, the method comprising:

(a) providing an extendable fitness bar, comprising:

a first external bar and a second external bar that are both hollow, each having a diameter substantially equal to one another, each external bar having a proximal and a distal end, the proximal ends of each external bar are an end of the first external bar and an end of the second external bar that are oriented closest to one another, while the distal ends of each external bar are an end of the first external bar and an end of the second external bar that are oriented furthest from one another, the proximal ends are positioned so that they are directly facing one another;

an internal bar being hollow and located on an interior of the first external bar and the second external bar;

an elastic member located in an interior of the internal bar, the elastic member having a first end that is attachable to the distal end of the first external bar and a second end that is attachable to the distal end of the second external bar, so that the elastic member produces resistance when the first external bar and the second external bar are moved away from one another, revealing the internal bar; and a first hollow interlocking bar located at the proximal end of the first external bar, and a second hollow interlocking bar located at the proximal end of the second external bar, one of the interlocking bars having an indent and the other interlocking bar having a protrusion that fit into one another when the first and second external bars are pressed together, and a total diameter of a section of the interlocking bars having the indent and the protrusion is substantially similar to the diameter of the first and second external bars, the internal bar also located on an interior of the first hollow interlocking bar and the second hollow interlocking bar;

(b) grasping the first external bar with one hand, and grasping the second external bar with another hand and directing the first and the second external bars in opposing directions, creating distance between the first external bar and the second external bar, creating tension from the elastic member, and revealing the interior bar; or (c) grasping the first external bar with one hand, and grasping the second external bar with another hand and twisting the first external bar clockwise and the second external bar counterclockwise.

2. The method of claim 1 including step (b), grasping the first external bar with the one hand, and grasping the second external bar with the another hand and directing the hands in opposing directions and create the distance between the first external bar and the second external bar, creating the tension from the elastic member and revealing the interior bar.

3. The method of claim 2, wherein the first external bar and the second external bar are made of polyvinyl chloride, wood, metal, or plastic.

4. The method of claim 1 including step (c), grasping the first external bar with the one hand, and grasping the second external bar with the another hand and twisting the first external bar clockwise and the second external bar counterclockwise.

5. The method of claim 1, wherein the elastic member is an elastic band.

6. The method of claim 1, wherein the elastic member is a spring.

7. The method of claim 1, wherein the extendable fitness bar further comprising an internal piece located on the interior of the first external bar and the second external bar fixing a total distance the first external bar and the second external bar may separate from one another.

8. The method of claim 1, wherein the extendable fitness bar further comprising a first hollow attaching bar located at the distal end of the first external bar, and a second hollow attaching bar located at the proximal end of the second external bar, the first hollow attaching bar having one or more indent, any of which one end of the elastic member is attached to, the second hollow attaching bar having one or more indent, any of which the second end of the elastic member is attached to.

* * * * *